US006977329B2

(12) United States Patent
Vans Evers

(10) Patent No.: US 6,977,329 B2
(45) Date of Patent: Dec. 20, 2005

(54) APPARATUS AND METHODS FOR INCREASING THE TONAL COMPLEXITY AND QUALITY OF LIVE AND RECORDED MUSICAL INSTRUMENTS

(76) Inventor: Claude M. Vans Evers, 5815 6th St., Tampa, FL (US) 33611

( * ) Notice: Subject to any disclaimer, the term of this patent is extended or adjusted under 35 U.S.C. 154(b) by 236 days.

(21) Appl. No.: 10/091,020

(22) Filed: Mar. 4, 2002

(65) Prior Publication Data

US 2003/0164086 A1 Sep. 4, 2003

(51) Int. Cl.[7] ..... G10D 3/02
(52) U.S. Cl. ..... 84/294; 84/453
(58) Field of Search ..... 84/294, 410, 453

(56) References Cited

U.S. PATENT DOCUMENTS 4,602,548 A 7/1986 Conklin, Jr.
4,941,389 A * 7/1990 Wendler ..... 84/727
4,989,491 A 2/1991 Baggs
5,265,513 A 11/1993 Smith
5,889,222 A 3/1999 Burgess
5,965,832 A 10/1999 Davidson
5,986,195 A * 11/1999 Liao ..... 84/410
6,127,611 A * 10/2000 VansEvers ..... 84/294

* cited by examiner

*Primary Examiner*—Jeffrey W Donels
(74) *Attorney, Agent, or Firm*—David Guerra

(57) ABSTRACT

A musically resonant apparatus with continuously variable resonances and methods for increasing the tonal complexity and quality of live and recorded musical instruments utilizes the position of one or more movable resonators to determine the freely resonant dimensions of the resonators comprising the apparatus. The dimensions and materials of this apparatus are scaled and selected to resonate in one or more musically relevant frequency ranges for the instrument and musical situation it is to be used with. The apparatus is mechanically coupled to a microphonic or vibrationally sensitive component in the chain of equipment between a musician and the listener. The continuous adjustability of one or more resonators allows the user to easily select the best complimentary resonances. This improves an instrument's tonal complexity, and thus its tonal quality at the listener's ears quickly, easily, and economically without invasive techniques.

20 Claims, 5 Drawing Sheets

FIG. 1A
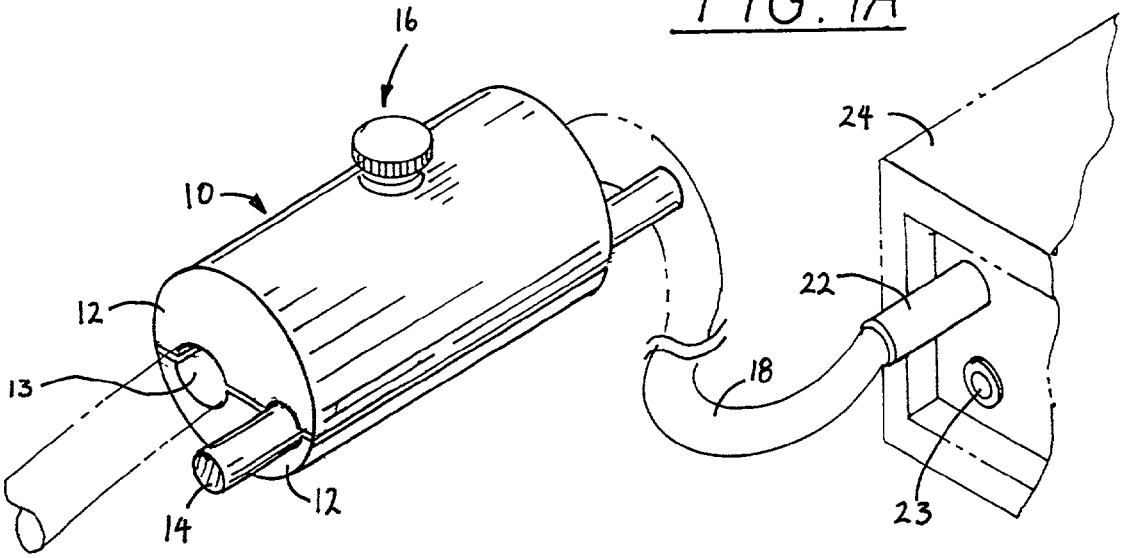
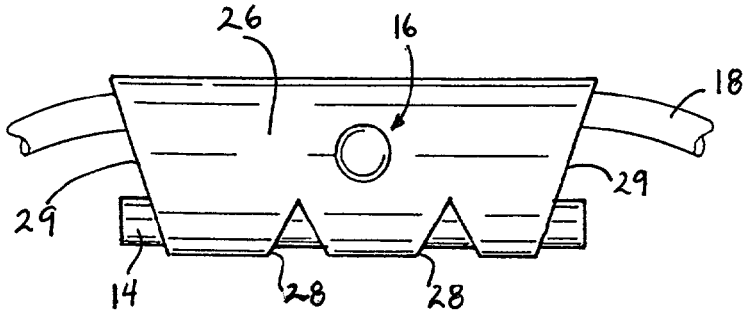
FIG. 1B
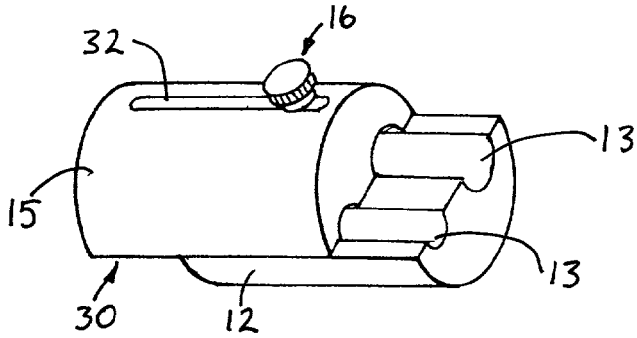
FIG. 1C

APPARATUS AND METHODS FOR INCREASING THE TONAL COMPLEXITY AND QUALITY OF LIVE AND RECORDED MUSICAL INSTRUMENTS

BACKGROUND OF INVENTION

1. Field of the Invention

This invention relates generally to the field of musical instruments, and more particularly to a musically resonant apparatus with continuously variable resonances and methods for increasing the tonal complexity and quality of live and recorded musical instruments.

2. History of the Art

All music traditions evolved from, and are rooted in acoustic instruments and how their sound both inspired the musicians and commanded the attention of those listening to them. The evolution of the dulcimer into a piano, with a pause at the harpsichord is a prime example of the natural development of musical instruments toward louder and improved tone quality.

The desire for a rich and satisfying tone quality also holds true for sound engineers and music listeners who experience music through the medium of recordings. Because of this, the opportunity for improving the tone quality of an instrument is not restricted to only the "now" of a live performance. It is equally to be found at the "in between" of the recording, mixing, and mastering stages, and even the "later" of a listener's living room. However, a common problem is that a complex, rich and satisfying tone often equates with "expensive," and this fact often presents severe limits to those on a limited budget, especially students.

Tone quality is not a single entity that is universal for all instruments, or even for one type of instrument. However, if there is one single aspect of an instrument's tone that denotes quality, it is complexity. A complex tone has a wide range of harmonics in a rich and satisfying blend. The relative strengths of these different harmonics are combined in the ear by a process called fusion, which results in both the perception of pitch and the characteristic tone of the instrument.

It is well known that musical instruments are extremely sensitive to what they are made from and how they are made. If the species of wood used for a guitar's sides and back is changed, a radical alteration is made to the sound of an otherwise identical guitar. This sensitivity to the resonant qualities of the materials that an instrument is made from extends down to its smaller parts and finish. What might be considered inconsequential to those not experienced in a particular craft still affects an instrument's sound in 'subtle but significant' ways. A violin's varnish is well known even to many outside the field of instruments and music to have an important effect on its sound. Other "minor" details important to those in their fields include the thickness of a trombone's bell, and the type of insulation on the magnet wire of a guitar pickup. However, vibration-sensitivity to 'minor' details is not just confined to musical instruments in this modern world of recordings.

While computer and digital technologies are an important driving force in the music world today, so is a technology that was almost completely replaced before it made a major comeback. At one point in both the recording and the home-listening communities, the tube was almost completely superceded by transistors and analog integrated circuits.

A few recording engineers and record producers retained some of their tube signal processing electronics instead of trading them in on the solid-state versions available since the 1970's. They used these tube products to add a warmth and smoothness they couldn't achieve with solid-state equipment. Their work became so well regarded that others started copying their methods, and these others too became widely copied.

Because of this, the tube has made an almost miraculous comeback and vintage tube electronics are today expensive, high-status items found in every major recording studio. Tubes are an accepted symbiotic companion to the almost universal use of digital recorders and signal processors. The recent advent of relatively inexpensive digital signal processors and recorders has turned a specialized trend for vintage tube electronics into a general trend that covers any and all tube products, and extends down to the smallest home recording studio.

The same comeback has occurred with a significant number of home listeners. They feel that music has a more natural and "live" quality when vintage tube components are used in their audio systems.

Many tube products are available, for home and professional use, in all price ranges up to a hundred thousand dollars or more. The tube renaissance seems unstoppable; some companies that opposed the trend several years ago have had to publicly change their stance and reintroduce tube products they stopped making 25 or more years ago.

The vibration-sensitivity of a musical instrument is paralled in tube equipment because of the tube's microphonic nature. Instead of being impervious to vibrations, a tube will convert some percentage of the vibrational energy to which it is subjected into an AC voltage, which is added to the signal it is passing. Every tube is microphonic to one degree or another, and they often become more microphonic as they age. While the vibration-sensitivity of a musical instrument is taken into account during its construction, the vibration-sensitivity of a tube is usually ignored. Electronics using tubes cannot help but often be as sensitive as musical instruments to the materials and techniques of construction.

Vintage tube products were made from heavy gauge steel, used wax covered capacitors and big carbon composition resistors with heavy gauge wire leads, and their cloth-covered wires were soldered point-to-point. Modern tube products are usually made with the thinnest possible sheet metal and/or plastic chassis, hard epoxy-coated capacitors and small ceramic-core resistors with thin wire leads, and their plastic-insulated wires are terminated with plastic-covered, thin-metal quick disconnects. The profusion of thinner and smaller parts cannot help but create an abundance of resonances much higher in frequency than those of 25 or more years ago.

As a result, modern tube electronics seldom have the same warm and smooth sound of prized vintage tube electronics, and the cost of vintage electronics in every genre of use is ever increasing. This puts them out of range for many who would otherwise prefer the added warmth and smoothness that they bring to the sound of ones favorite musical instruments, live or recorded. However, the same microphonic characteristic that causes the problem can be used to counteract it.

Musical instruments have many avenues for tonal improvement after having left the factory. There are many aftermarket manufacturers of reeds, mouthpieces, strings, pickups, bridges, tuning nuts, etc., all for the improvement of an instrument's tone. As tube electronics are vibration-sensitive like musical instruments, they can also have their resonance signature modified after leaving the factory. Obvious ways include clamping or attaching resonators directly to the chassis of a tube product. However, there are other, less obvious methods that also allow the modification of the resonance signature of vibration-sensitive tube products. The following example is given to illustrate the fact that while the remoteness of a set of resonances may seem at first glance to obviate its ability to effect tone, these resonances are in fact often a significant contributor to overall tonal quality.

It is common knowledge that the degree of tension in a musician's arm and shoulder muscles has a significant effect on an instrument's tone. A reduction of muscle tenseness will mellow not only the musician but also the tone produced by an instrument. The resonant energy of the strings passes through the bow-hair, through the wood of the bow, and into the musician. This energy is filtered by the resonances in the bow-hair, the wood of the bow, and the combination of the mass and spring-rate of the musculature of the arms and shoulders, and coupled back into the instrument where it adds to the resulting tonality.

Some of these effects of external resonances on a musical instrument also find a parallel with tube equipment. The flexibility of input and output cables is not a barrier to most transverse or longitudinal vibrations. These cables are solidly and mechanically coupled to a rigid chassis that provides little to stop vibrations from being conducted to microphonic tube elements. The energy conducted through these cables is sufficient to affect the tone of tube equipment. This situation has an analogy in the energy conducted through a bow or the muscles of a musician.

An instrument's tonality is also a result of how long it has been played. The difference between a new instrument and an old one that has been in constant use for decades is in part that the old instrument has become more full-bodied and less strident in sound through having been played for many years. This is a process called "break-in." If an older, well used instrument is not played for months, there will also be a re-break-in period. However, it will be measured in days or weeks, rather than the many years necessary to break-in a new instrument. An associated phenomenon can be called an instrument's tonal memory.

Some musician's are reticent to loan their instrument to another musician, because when it is returned, it will not sound the same as when it left. The tone slowly returns to its former character in a week or less. This temporary break-in of new tonal characteristics is thought to be the result of the differing playing techniques of the players, and also from their differing bow and musculature resonances. While an instrument's tonal memory can be an annoyance, I have discovered that it can also be used for beneficial purposes.

Prior Art

Musical instruments are usually collections of important resonating parts such as strings, reeds, bars, plates, air pipes and chambers, and the accompanying connecting/positioning parts that are also resonant and contribute to an instrument's tonality. Acoustic improvements to musical instruments are usually comprised of additions of resonant parts or an additional mass strategically placed.

U.S. Pat. Nos. 4,602,548 and 5,889,222, are both concerned with strategically placed weights.

U.S. Pat. No. 4,989,491 concerns the addition of multiple internal resonators to affect a single frequency range.

U.S. Pat. No. 6,127,611 concerns the use of multiple external resonators to affect multiple frequency ranges.

U.S. Pat. No. 5,265,513 concerns the use of resonant materials as inserts in a strategic place.

A slightly different approach is found in U.S. Pat. No. 5,965,832 where a dampening compound is used to eliminate non-pleasing structural resonances.

Deficiencies in Prior Art

The approaches made to effect various tonal modifications often have side effects that will either restrict or eliminate their usefulness. For example, a "weight" or a "mass" is usually made from a metal. Its dimensions and the resonances they cause, as well as the resulting metallic coloration of the upper harmonics of the instrument is usually ignored. Other approaches will often be too complex for widespread use by either craftsmen or musicians.

The weight used in U.S. Pat. No. 4,602,548 is comprised of a mass that is preferably made of brass, and is fastened to a piano's bridge and soundboard with a threaded steel stud. While the sonic impact may be as desired at a tonal discontinuity as described, the additional bright and metallic resonances contributed by the steel stud and the small dimensions of the brass compensation weight may not be welcome, as its effect is not just felt at the tonal discontinuity. A musician desiring a warm, not-bright tone could easily find this side effect undesirable. Furthermore, many musicians will not welcome or allow the drilling of holes in their pianos.

Another focused approach is found in U.S. Pat. No. 5,889,222 where a weight is attached to various portions of various stringed instruments. This calibrated-weight clamp has intrinsic resonances that are not given sufficient importance in their impact on an instruments sound. For instance, it is well known that there are two major schools concerning cello tonality. There is the warmer/darker/richer-is-better school, and the brighter-is-better school. A steel, brass, or aluminum device will not satisfy the former while only possibly delighting the latter because its metallic construction will augment certain portions of the instrument's upper harmonics. I have discovered that the inherent upper harmonic augmentation of metallic resonators clamps or otherwise, can easily cause an increase in the friction from drawing the bow across the strings. Usually this will not be appreciated, and thus can easily negate any benefit provided by the weight.

An instrument that has had the complex sonic treatment found in U.S. Pat. No. 4,989,491 will at least in part be full and warm sounding, which is the stated goal of this patent. However, if the wrong material is selected for these fixed resonators or for the resonator support bars, it can easily cancel the good will created by the augmented lower harmonics. While the resonator's modulus of elasticity and length can be selected to create a specific fundamental resonance, the accompanying harmonic series can easily be rich in unpleasant upper harmonics. This trade-off will be unacceptable to many musicians. The inherent complexity can also cause problems in the event of needed repair at a distance from the builder of the instrument.

The invention in U.S. Pat. No. 6,127,611 is adjustable, and therefore quite versatile in its tonal modification capabilities. However, in the main, the adjustments result in stepped, and not continuously variable, resonant frequency changes. It is possible to find a situation where one can find resonant combinations that bracket a desired tonal modification, without getting it exactly right. This eventuality is somewhat counteracted by the high number of adjustments possible. However, many musicians will find this same high number of adjustments intimidating.

The invention in U.S. Pat. No. 5,265,513 is adaptable in that multiple tonal results are possible by substitution of different resonant members. This results in " . . . an extremely large number of variations . . . " which cannot help but also be intimidating to both the musician wanting a specific tonality from his or her particular instrument, and the artisan trying to learn how to accomplish it.

In U.S. Pat. No. 5,965,832 anti-resonant hot-melt adhesive is used to dampen structural resonances in brass instruments that contribute unpleasant harmonics to an instrument's tone. To most musicians this will be considered unsightly, and significantly detract from their desire to use this technique. To many musicians, looks are often more important than the end result.

Microphonic electrical and electronic products also have parts whose resonances contribute to their tonality. Traditionally, passive and active equalization (EQ) has been used since its development as the usual means of compensating less than perfect recording and playback situations and equipment. However, EQ introduces frequency dependent phase shift into the signal. As more EQ is used, more phase shift occurs. Many musicians and engineers would rather not inject this type of distortion into their music, as they find it sonically objectionable. Their preferred solution is to use equipment and spaces that do not need much, if any EQ. This can be an expensive solution, and therefore presents limits to the many that would prefer it, but can not afford it.

There is no prior art concerning a continuously variable apparatus for increasing the tonal complexity and quality of a musical instrument that easily adds multiple complementary mechanical resonances to microphonic electrical or electronic equipment.

A simple yet highly effective apparatus that can significantly improve the tonal complexity and quality of multiple families of acoustic musical instruments, and one having no unknown side effects has no prior art.

There is no prior art concerning a single continuously variable apparatus that can be configured and used to increase the tonal complexity and quality of multiple varieties of musical instruments, and multiple varieties of microphonic electrical or electronic equipment, as the need arises. The need for such a complementary resonant apparatus is realized by the present invention.

SUMMARY

Accordingly, it is the object of the present invention to provide an apparatus with continuously variable resonances for increasing the tonal complexity and quality of musical instruments that avoids the disadvantages of the prior art.

More particularly, it is an object of the present invention to provide a simple and easy to use apparatus with no unintended side effects that can be configured to increase the tonal complexity and quality of both live and recorded musical instruments. Its resonating assembly can be scaled to size and used in this age of recordings with one or more of the potential host components comprising the chain of equipment between a musician and a listener. Host components include, but are not limited to musical instruments, and/or vibration-conducting connecting cables used with powered microphonic audio equipment, and/or microphonic cables, and/or other passive microphonic devices. The present invention is sonically adaptable by mechanical means to a degree previously restricted to swept-frequency equalizers.

When a musically resonant apparatus with one or more continuously variable resonances is designed in accordance with the present invention, musicians will have an inexpensive but powerful means for generating a more complex and beautiful tone from their instruments. This improvement will result in a tonal quality that many times they could not otherwise have afforded, especially with students and their very inexpensive instruments. This will give them greater pleasure in the playing of their instruments, and inspire them to greater efforts in the pursuit of their craft.

When a musically resonant apparatus with one or more continuously variable

When a musically resonant apparatus with one or more continuously variable resonances is designed in accordance with the present invention, recording, mixing, and mastering engineers will have an inexpensive but powerful means for improving the tonal quality of recorded musical instruments. This can be accomplished through the compensation of the previously ignored mechanical resonance signature of microphonic or vibrationally-sensitive apparatuses and electronics, which will reduce or eliminate the use of electronic equalization (EQ) and its resultant and problematic phase shift distortion of harmonics.

When a musically resonant apparatus with one or more continuously variable resonances is designed in accordance with the present invention, home audio enthusiasts will have an inexpensive but powerful means for improving the tonal quality of recorded musical instruments. This can be accomplished through the compensation of the previously ignored mechanical resonance signature of microphonic electronics in audio systems that traditionally use little or no EQ.

Vibrational energy from a musical instrument, either from the instrument itself or from speakers powered by one or more amplifiers whose signal source is from live or recorded musical instruments, excite the materials of the present invention. The individual resonances of these materials add their characteristic audio frequency energy to that of the host device. In the case of a vibrationally sensitive musical instrument, the resonator assembly's energy is added to the radiated acoustic energy of the instrument itself. In the case of microphonic cables and passive devices such as but not limited to microphones, the resonator assembly's energy is added to the electrical signal passing through the cable or device. In the case of active microphonic electronics such as but not limited to those using tubes, the resonator assembly's energy is added to the electrical signal passing through the microphonic electronics.

The acoustic and mechanical resonance signature of the present invention is a function of the shape, material, and surface contours of its primary resonators and all other parts. All parts of the present invention are resonators having tonal significance. The resonant signature is also a function of the contact area of the various resonators against each other or against another solid object, and of the freely resonating dimensions of the resonators not in contact with another resonator or solid object. In addition, the resonant signature of the present invention is also a function of the size and material of the fasteners themselves.

One feature of the present invention concerns the use of musically relevant resonators as the elements of its realization. This is especially true for the embodiment that uses clamping members to hold this apparatus to its host, and to hold the movable resonator. The use of musically relevant resonances practically eliminates unintended tonal side effects as commonly found when the main focus is on a weight or a mass. Because of this focus on the musicality of its elements, the likelihood is increased for the present invention to add to a musical instrument's live or recorded tone in a desired and pleasing manner.

Another feature of the present invention concerns its use of a resonating assembly whose resonance characteristics are in part continuously variable, a simple yet powerful feature. Without changing resonators, a wide range of tonal effects is possible, which reduces problems associated with matching the present invention's tonality to the desires of its user. This is not possible with a single weight or a mass. This variability also allows a single version of the present invention to be used with multiple instruments that are not necessarily of the same family, and also with other vibration sensitive or microphonic host components.

Yet another feature of the present invention concerns the pre-selection and use of musically relevant resonator dimensions and materials for the instrument and musical situation at hand. This results in the ability to prepackage several general areas of tonal emphasis for a particular musical instrument or other host component. This simple methodology can achieve superior results because the user can decide which part of their tone needs improvement, instead of hoping that a product that was designed to improve someone else's tone will also help theirs.

Yet still another feature of the present invention concerns the ability of the present invention to take advantage of the tonal memory of vibration-sensitive apparatuses such as, but not limited to, acoustic stringed instruments. Because of the present invention's adjustable nature, it can, for instance, be used in one resonant configuration on a musical instrument one day, and in another and different configuration the next day. This will result in a summation and simultaneous occurrence of the two separate tonal enhancements that will continue for as long as alterations of configurations happen on a regular and timely basis. This allows a simple apparatus to achieve powerful results, and in effect, lowers the cost of the present invention. This lower cost will allow many student musicians to be able to afford a tonal complexity and quality previously unobtainable in their price range.

Yet another feature of the present invention concerns its ability to be dimensionally scaled to work with any instrument and increase the complexity and quality of its tone in any part or parts of that tone as desired.

A significant feature of the present invention concerns its ability to use common materials in the manufacture of the present invention. This means that the cost to its user will be much less than if expensive materials such as musical instrument quality indented spruce or titanium were required.

Other objects and advantages of the present invention will become apparent from the following descriptions, taken in connection with the accompanying drawings, wherein, by way of illustration and example, six embodiments of the present invention are disclosed.

BRIEF DESCRIPTION OF THE DRAWINGS

In the drawings, closely related figures have the same number but different alphabetic suffixes.

FIG. 1A is an isometric view of the present invention showing its use on a guitar amp input cable.

FIG. 1B is an overhead plan view of an alternative embodiment of FIG. 1*a* showing surface contours.

FIG. 1C is an isometric view of another alternative embodiment of FIG. 1*a* showing a second movable resonator.

REFERENCE NUMERALS IN DRAWINGS

Figure 2:
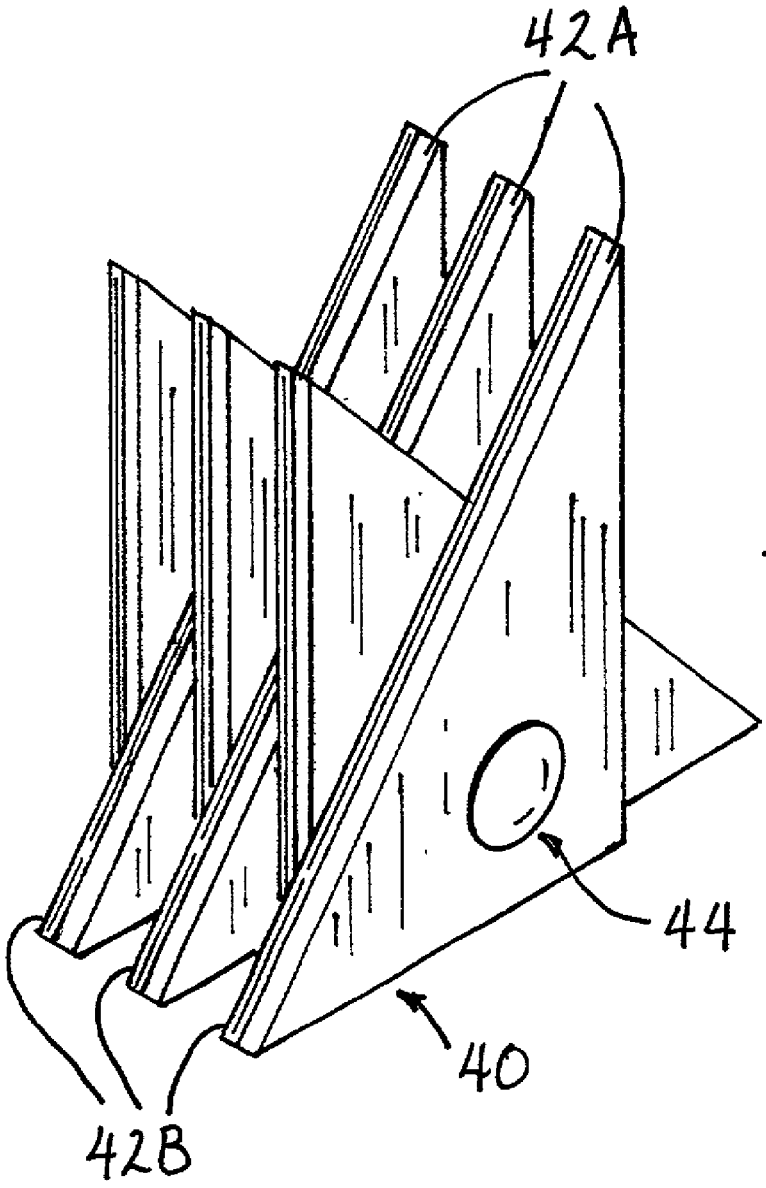
FIG. 2 is an isometric view of an alternate embodiment of the present invention showing spaced flat plate resonators.

10 first embodiment
12 outer resonator
14 rod-shaped movable resonator
15 movable outer resonator
16 fastener A assembly
18 signal cable
22 cable plug
23 input jack
24 tube guitar amp
26 beveled and notched outer resonator
28 notch
29 beveled end
30 alternate embodiment of FIG. 1A
32 slot
40 second embodiment
42A flat plate movable resonator type 1
42B flat plate movable resonator type 2
44 fastener B assembly
50 third embodiment
52 support resonator
54 adjustable fastener
60 fourth embodiment
62 bar resonator
64 movable bar resonator
65 slot
66 fastener C assembly
67 wingnut
68 T-slot
80 fifth embodiment
81 fastener D assembly
82 spacer
84 slot
86 slotted crescent-shaped movable resonator
88 crescent-shaped resonator
89 cylindrical portion of host component
90 sixth embodiment
91 insulated wire
92, 94 length defining resonance #1
95 knot having resonance #3
96, 98 length defining resonance #2
101A previous wire #1
101B previous wire #2
103 solder joint

DETAILED DESCRIPTIONS OF THE DRAWINGS

Descriptions of the preferred embodiments of the present invention are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

Referring now to FIG. 1A, a present embodiment 10 of a musically resonant apparatus with continuously variable resonances of the present invention is shown, two outer resonators 12, gripping surface 13, rod-shaped movable resonator 14, fastener A assembly 16, signal cable 18, signal cable plug 22, input jack 23, and tube guitar amplifier 24.

The two outer resonators 12 are preferably made of wood, with the grain of the wood normally in the same direction as the long axis of a rod-shaped movable resonator 14. Outer resonators 12 are sized in length to contribute resonances that are within the tonal range of the guitar the musician is playing, as different guitars have different tonalities. Outer resonators 12 are shown to have a long axis length greater than the diameter of embodiment 10. This length is flexible and should be matched to the musical situation at hand.

Wood is a non-homogenous, anisotropic material and sound travels easiest and with the highest velocity along the direction of the continuous internal structure of wood called the wood fiber. This internal structure is in the form of cross-linked rectangular "tubes" imbedded in an amorphous lignin matrix. Embodiment 10 has all tubes of the same length and the resulting resonant frequency from longitudinal vibrations therefore forms a narrow band, high-Q resonator. An axial length of approximately three-quarters of an inch would be used when extra middle midrange is to be emphasized, and an axial length of approximately an inch and a half would be used when bass is the preferred contribution of outer resonators 12. The exact lengths will vary according to the species and even the tree from which the wood came.

Gripping surfaces 13 are incised into the inner surfaces of the outer resonators for the purpose of fixing the position of rod-shaped movable resonator 14 and embodiment 10 to a portion of the host component, in this case a signal cable to a tube guitar amplifier 24. These surfaces can be seen more clearly in FIG. 1C. These surfaces are shown cut to fit rod-shaped moveable resonator 14, and extend through both ends. However, they can vary as needed for a particular application.

The ability to preselect tonal outcome as a function of axial length enhances the effectiveness of wood not normally used in musical instruments. For darker tones walnut is preferred; for rounded full range tones common red oak is preferred; for lighter tones with more treble emphasis common maple or pine is preferred. Scarce and exotic "tone" woods are not necessary for the proper function of the present invention.

The diameter of embodiment 10 is a function of the diameter of rod-shaped movable resonator 14, and the dimension of the intended member of the host component. A signal cable 18 is shown but other members of a host component can be used, cylindrical or otherwise, as long as the dimension is within the gripping range of embodiment 10 of the present invention.

A rod-shaped movable resonator 14 is preferably of wood or certain metals such as copper or brass. Other materials can be used but only if their resonances complement the intended musical situation. Plastics and aluminum are materials whose resonance signatures are much less musical than the preferred materials noted. The length of rod-shaped movable resonator 14 is selected for the range of frequencies suitable for the musical situation at hand. The freely resonant lengths of rod-shaped movable resonator 14 will be those not in contact with the outer resonators 12.

A rod-shaped movable resonator 14 made from copper will result in a less bright tonal emphasis compared to brass. Copper and brass are commonly available and are the metals of preference. Wood is also a preferred material for rod-shaped movable resonator 14, and the direction of grain should normally be the same as its long axis. The intrinsic tonal signatures of the preferred woods for outer resonator 12 are the same when these common and easily found woods are used for rod-shaped movable resonator 14.

Fastener A assembly 16 is usually metal and care should be taken to ensure that the resulting metallic resonances are not objectionable for the musical situation at hand. However, as these resonances are in effect filtered by the wood of outer resonators 12, they are usually attenuated to non-objectionable levels before being coupled into the host component. This is an improvement over the usual method of applying metallic objects directly to an instrument.

Referring now to FIG. 1B, an alternate embodiment of FIG. 1A of a musically resonant apparatus with continuously variable resonances of the present invention is shown, rod-shaped movable resonator 14, fastener A assembly 16, signal cable 18, beveled and notched outer resonator 26, notch 28, and beveled end 29.

Here, surface contours comprise a resonance modification designed to lower the Q of the longitudinal resonances, and increase the level of higher harmonic resonances. Cutting at an angle across the wood fibers and thus creating beveled ends 29 of outer resonator 12 causes a multiplicity of different length tubular pathways for longitudinal vibrations which in turn creates a wideband, low-Q sympathetic resonating system. Much shorter length tubular vibrational pathways are created with notch 28 for the purpose of creating and shifting the tonal emphasis of resonator 26 towards the higher harmonics. In this way common woods can further be tailored to reduce the need for use of exotic and scarce tone woods.

Referring now to FIG. 1C, another alternate embodiment of FIG. 1A of a musically resonant apparatus with continuously variable resonances of the present invention is shown, outer resonator 12, movable outer resonator 15, fastener A assembly 16, alternate embodiment 30, and slot 32. Rod-shaped movable resonator 14, and signal cable 18 are omitted for sake of clarity.

Here slot 32 is incised into a non-movable outer resonator 12 in order to allow movement. A movable outer resonator 15 will allow its user to continuously vary the resonant signature of embodiment 30 in case of loss of rod-shaped movable resonator 14. In addition, a further level of tonal complexity can also be contributed to the sound of the host component when used in conjunction with rod-shaped movable resonator 14.

Referring now to FIG. 2, a second embodiment 40 of a musically resonant apparatus with continuously variable resonances of the present invention is shown, flat plate movable resonators 42A and 42B, and fastener B assembly 44.

Here is shown embodiment 40 whose dimensions were designed for ease of use in creating and emphasizing midrange and treble harmonics. Wood is the preferred material, and many species of hardwoods and softwoods are suitable. The length of the wood fibers of each flat plate movable resonator 42 left exposed and not clamped against its neighbor determine a significant portion of the resonances of that exposed portion. The triangular shape of flat plate moveable resonators 42A and 42B causes a multiplicity of different length tubular pathways for longitudinal vibrations, which in turn creates a wideband, low-Q resonance. Shapes other than triangular often are less effective in generating upper harmonics.

As shown, the grain direction of the woods used in FIG. 2 lies in the direction of the long adjacent side of the triangular plates of embodiment 40. This configuration provides longer wood fiber lengths than if the wood grain were at right angles to that as shown. These longer wood fiber lengths will resonate lower in frequency and contribute more emphasis to the midrange than will shorter lengths. If the wood fibers were at right angle to those shown, they would be shorter and contribute more emphasis to the treble range of a host component.

While two different types of flat plate movable resonator 42 are shown, a single material can also be used. Useful variations of flat plate movable resonators 42A and 42B would include different wood species or grain orientation.

The thickness of the stack of resonators 42A and 42B, as well as the individual thicknesses of the plates themselves also affect the overall resonant signature contributed to the host component. A thicker stack of resonators 42 will have a resonant contribution lower in frequency due to resonant energy traveling at right angles to the plane of the individual flat plate movable resonators 42A and 42B, than will a thinner stack. Each freely resonant portion of movable resonator 42A or 42B will be under the influence of transverse vibrations as well. A thicker flat plate movable resonator 42A or 42B will be stiffer and thus contribute higher resonant energy than will a thinner one.

Figure 3A:
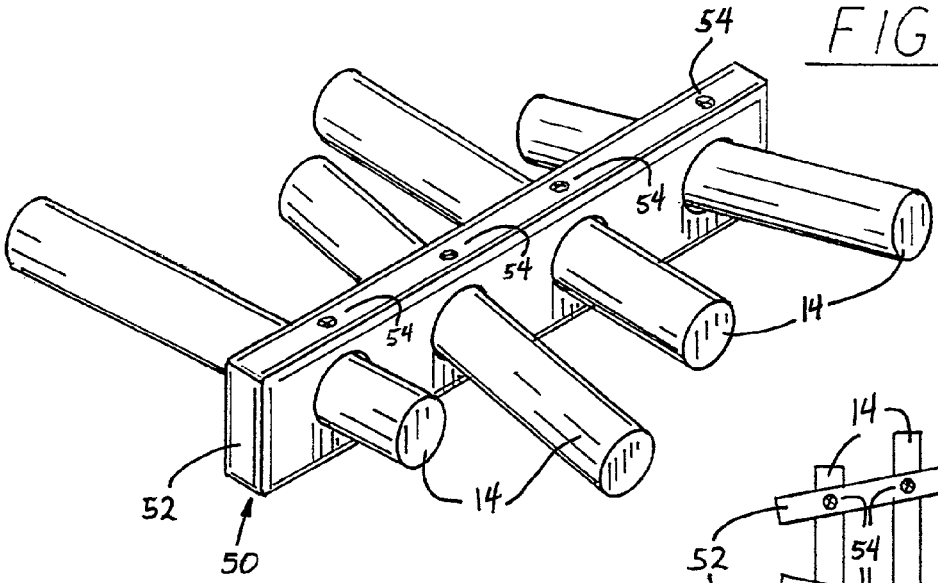
FIG. 3A is an isometric view of an alternate embodiment of the present invention showing one support resonator and multiple movable resonators.
Figure 3B:
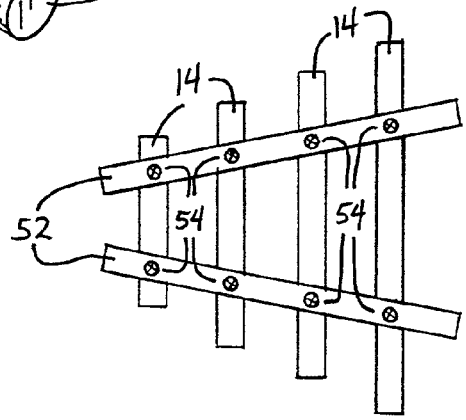
FIG. 3B is an overhead plan view of an alternate embodiment of FIG. 3A showing two support resonators and a spread resonance configuration.
Figure 3C:
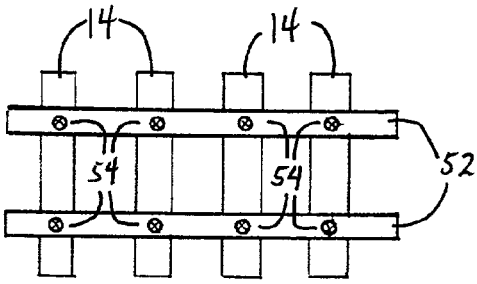
FIG. 3C is an overhead plan view of an alternate embodiment of FIG. 3A showing two support resonators and a multiple equal resonance configuration.

Referring now to FIGS. 3A, 3B, and 3C, a third embodiment 50 of a musically resonant apparatus with continuously variable resonances of the present invention is shown, rod-shaped movable resonator 14, support resonator 52, and adjustable fastener 54.

The freely resonant lengths of rod-shaped movable resonator 14 will be those not in contact with support resonator 52. Copper, brass, and the common woods walnut, red oak, maple, and pine are preferred materials that can be used singly or in combination.

Support resonator 52 is shown with four equally spaced rod-shaped movable resonators 14. The number and spacing will vary as to the density of increased tonal complexity needed. Regular spacing will create multiples of equal resonances, whereas Golden Mean, logarithmic, or another progressive spacing will result in a staggered spacing of resonances due to the webs between the openings.

The openings of support resonator 52 are made such that rod-shaped movable resonators 14 can be splayed at multiple angles to that of support resonator 52. This flexibility allows the use of more than one support resonator 52 to accomplish a low-Q staggered configuration of resonant lengths as shown in FIG. 3B. A high-Q multiple equal resonance configuration is shown in FIG. 3C.

Figure 4A:
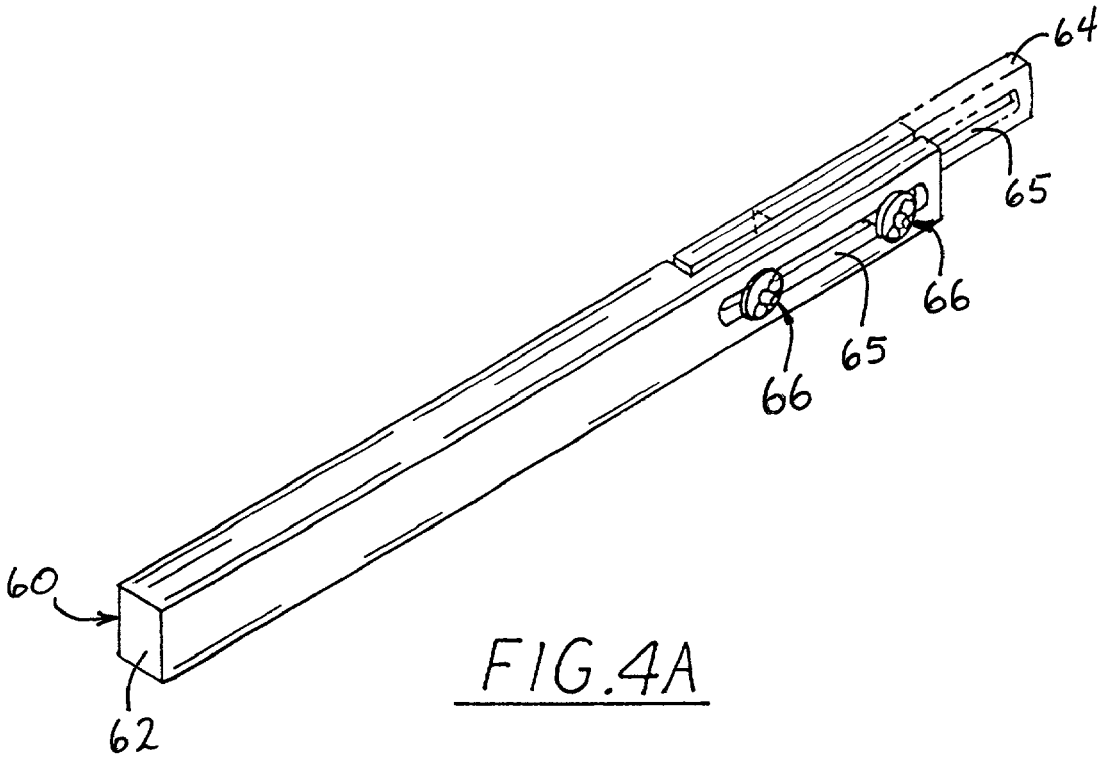
FIG. 4A is an isometric view of an alternate embodiment of the present invention showing a low frequency resonator with a midrange scaled movable resonator.

Referring now to FIG. 4A, a fourth embodiment 60 of a musically resonant apparatus with continuously variable resonances of the present invention is shown, bar resonator 62, movable bar resonator 64, slot 65, and fastener C assembly 66.

Figure 4B:
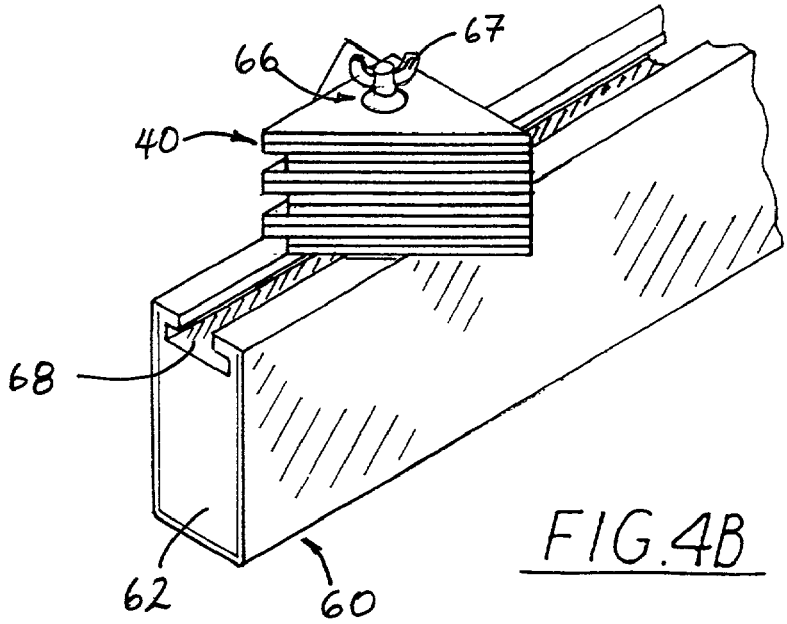
FIG. 4B is an isometric view of an alternative embodiment of FIG. 4A showing a moveable mounting of the apparatus of FIG. 2.

With embodiment 60, a physically long, low frequency emphasizing apparatus with continuously variable upper bass and lower midrange harmonics can be realized. The length, thickness, and type of wood chosen for bar resonator 62 will determine the resultant fundamental frequency of resonance. In the same way, the length, thickness, and type of wood chosen for movable bar resonator 64 will determine the range and strengths of the harmonics contributed by movable bar resonator 64. Referring now to FIG. 4B, an alternate embodiment of this fourth embodiment in FIG. 4A of a musically resonant apparatus with continuously variable resonances of the present invention is shown, second embodiment 40, bar resonator 62, fastener C assembly 66, wing nut 67, and T-slot 68.

Here is shown a T-slot 68 incised in bar resonator 62 as a continuously variable way of mounting the second embodiment 40 to bar resonator 62. In this way the upper harmonics contributed to a host component by embodiment 60 can be enhanced, and the mass contributed by embodiment 40 can be used to emphasize a user selectable harmonic of those generated by bar resonator 62 from transverse vibrations.

Figure 5A:
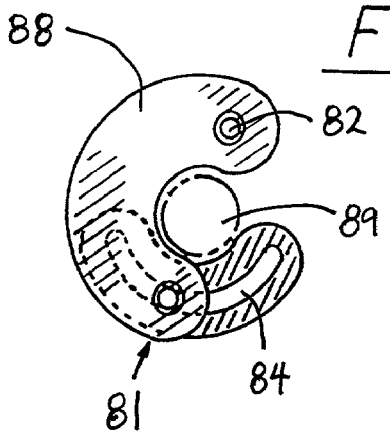
FIG. 5A is a side plan view of an alternate embodiment of the present invention showing its mounting on a cylindrical portion of a host.
Figure 5B:
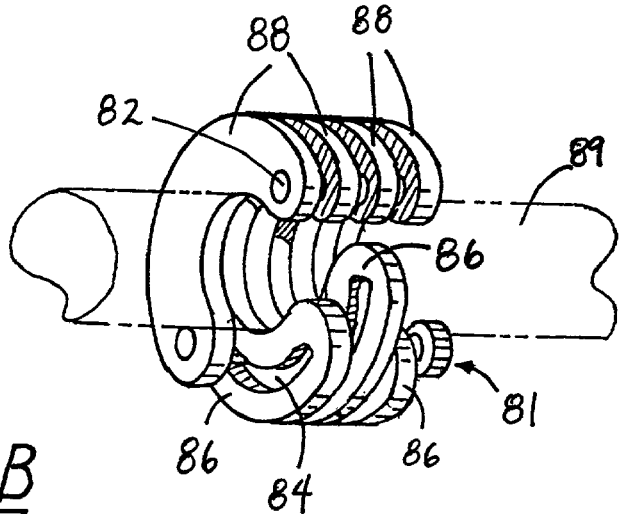
FIG. 5B is an isometric view of the embodiment of FIG. 5A showing different extensions of its movable resonators.

Referring now to FIGS. 5A and 5B, a fifth embodiment 80 of a musically resonant apparatus with continuously variable resonances of the present invention is shown, fastener D assembly 81, means of spacing 82, slot 84, slotted crescent-shaped movable resonator 86, crescent-shaped resonator 88, cylindrical portion of the host component 89.

In FIG. 5A the relationship of the slotted crescent-shaped movable resonators 86 to that of the crescent-shaped resonators 88 is illustrated. In FIG. 5B the ability to vary the lengths of the slotted crescent-shaped movable resonators 86 that engage the cylindrical portion of host component 89 is illustrated.

Copper and brass are the preferred materials for embodiment 80 of the present invention. The inner diameter of embodiment 80 will be scaled for the cylindrical portion of host component 89. The thickness of crescent-shaped resonators 88 and that of slotted crescent-shaped movable resonators 86 will be a major determining factor of the upper harmonics contributed by embodiment 80. A copper version of embodiment 80 of the present invention will be less bright tonally than a brass version, everything else being equal.

Figure 6:
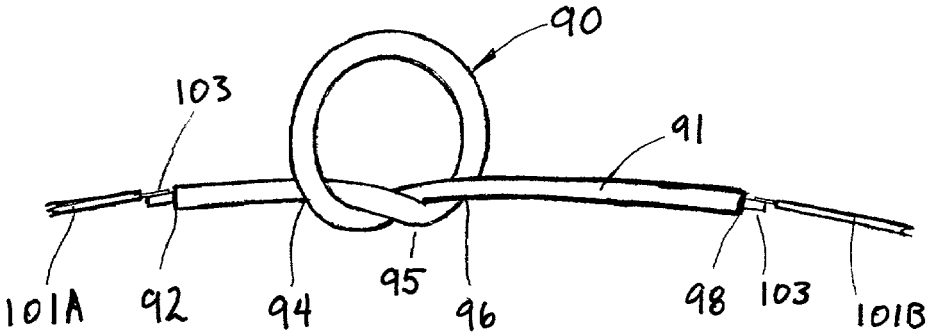
FIG. 6 is a plan view of an alternate embodiment of the present invention showing the relative lengths of the resonant elements.

Referring now to FIG. 6, a sixth embodiment 90 of a musically resonant apparatus with continuously variable resonances of the present invention is shown, insulated wire 91, resonance #1 is defined by the compliance, mass, and length of insulated wire 91 from 92 to 94, resonance #2 is defined by the mass of the knot 95 which is defined by its diameter and wire gauge, and resonance #3 is defined by the compliance, mass, and length of insulated wire 91 from 96 to 98. Other elements include previous wire 101A, previous wire 101B, and solder joint 103.

The analogy of a string having a mass attached to it at a point along its length is applicable to embodiment 90 of the present invention. The diameter of knot 95 is co-dependent with the length of insulated wire 91 from 92 to 94 and that from 96 to 98. The circular mills of insulated wire 91 will usually be relatively much greater than that of previous wires 101A and 101B which often will have been continuous and of one piece before installation of embodiment 90 of the present invention. In that added tonal warmth is often desirable, typical wire gauges for insulated wire 91 that will resonate in this range will include heavier gauges such as 16, 14, and 12.

Advantages

From the description above, a number of advantages of my musically resonant apparatus with continuously variable resonances become evident:

(a) The use of relevant and musically resonant elements in the apparatus practically eliminates unintended tonal side effects as commonly found when the main focus is on a weight or a mass.

(b) The continuously variable resonance feature allows this apparatus to remain simple and yet provide a user with a wide range of tonal effects to better match his or her desires, and also allows it to be used with more than one host component.

(c) The ability to design this apparatus with musically relevant dimensions and materials allows several different tonal enhancements to be prepackaged so that a user can select that which works better for his or her particular musical situation and host component. This is superior to trying multiple brands of other products, all of which purport to be the "best."

(d) This apparatus can be used to take advantage of the tonal memory of some musical instruments by alternating, on an every other day basis, different tonal configurations. This will give results comparable to that of a more expensive and complicated device.

(e) This apparatus can be designed to increase the complexity and quality of any or of all the harmonic regions in any musical instrument's tone.

(f) The ability to effectively use common woods and metals in the manufacture of this apparatus means that the cost to a musician, an engineer, or a home listener will be much less than if expensive materials were required.

Operation

The manner of use of the embodiments of the present invention of FIGS. 1A, 1B, and 1C is similar to that of a weight or mass clamped onto a musical instrument, with exceptions. Embodiment 10 can be directly coupled to a host component or indirectly coupled to an intermediary that is directly coupled to the host component.

The first exception is that with a weight or a mass there is little or no direct mental connection to the fact that the weight or mass has resonances of its own. These resonances can be equally as important or even more important than the resonance that the weight or mass was intended to alter. The resonances of the present invention are very predictable, and there will be no unintended side effects from ignored resonances because the resonances of the present invention are the focal point, not its mass. While the present invention does have mass, its mass is not at all considered. A plurality of equal mass embodiments 10 can easily have a plurality of resonance signatures.

The second exception concerns the predictability of the present invention's resonances. By listening to a musical instrument's tone, a preliminary decision can be made as to where in that tone there is a weakness. The necessary elements of embodiment 10 for correcting the weakness will then be easy to assemble.

A range of versions of the present invention can be easily assembled to cover the high, middle, and low frequency portions of an instrument's tonal range. If a user has no understanding of where in their tone they would like more complexity and quality, they can be given one of each to select between. From this generalized first step they will have a starting point to take advantage of the next difference.

The third exception is that the present invention is designed to be intrinsically continuously variable in one or more ranges of resonances, a function that would never be considered if using a conventional weight or a mass.

A rod-shaped movable resonator 14 normally extends from both ends of outer resonator 12. However, if warranted, extension from only one end can be desirable. Another possibility consists of using two rod-shaped movable resonators 14, one extending from each end. While this can give excellent results, it is, however, less simple to learn to use properly.

When both ends of rod-shaped movable resonator 14 are equal in length, their freely resonant lengths are equal. Their frequencies of resonance will also be equal, and added together will give twice the strength of a single resonator. As one end is lengthened, the other end is shortened. This lowers the frequency of resonance for the longer end, and raises the frequency of resonance for the shorter end. As the one end is lengthened and the other becomes shorter, the contrast between the two resultant resonances becomes greater and greater.

If a situation occurs where the upper resonance is to the user's taste but the lower resonance is either too high or too low, substitution of either a longer or shorter rod-shaped movable resonator 14 respectively, will be the solution.

The user has the ability to not only pick the area of tonal enhancement, but also the contrast brought to that area. This is a very powerful tool for getting a high quality and complex tone that is both distinctive and relatively even.

A further level of adaptability and complexity is furnished with movable outer resonator 15. The general selection process is the same as for versions of embodiment 10 of the present invention without movable outer resonator 15. After rod-shaped movable resonator 14 is adjusted for personal taste, movable outer resonator 15 is then also adjusted for personal taste. As there will be some interaction between the two movable resonators, some back and forth adjustment will often have to be made.

Even though embodiment 10 is primarily designed for clamping to a host component, a second rod-shaped movable resonator 14 could be used instead of, for example, signal cable 18. This alternate embodiment would then be placed on or in the designated host component, and gravity would supply one coupling force. Alternatively, the method of coupling could be through use of glue, an adhesive, a bracket, or other means. However, the resonant properties of the glue, adhesive, bracket, or other means would then have to be taken into account. In this case, some modifications to the resonant signature of the present invention might have to be made in order to compensate for any non-musical resonances of the mounting technique.

When embodiment 10 of the present invention is used with some host components, for example a stringed musical instrument, that instrument's tonal memory will multiply the ability of the present invention to affect the tonality of that instrument. Ten days after an improved tonality is created with the present invention, a new position can be found for rod-shaped movable resonator 14, or for the position of embodiment 10 on the instrument, or for both that will further improve the instrument's tonality. This new tonality will be the result of the combination of the resonances from the previous position and the new position, not just those from the new position. By alternating between the old position and the new on an every other day basis, the effects of the two positions will both be realized every day.

Some of the placements for embodiment 10 include the bocal of a bassoon or English horn, the connecting cables and structural elements of microphonic audio equipment, and the stands and head tensioning rods of percussion instruments. Other placements include the tuning keys of stringed instruments, on a musician's person, the endpins and straps of instruments that use them, piano bridges and frames, guitar headstocks, and the braces and tubing of brass instruments.

FIG. 2

The manner of use of embodiment 40 of the present invention is similar to that of embodiment 10. However, embodiment 40 is primarily designed to be gravity coupled, and thus it is placed on or in a host component. If use with several host components is not a factor, embodiment 40 can be permanently mounted. However, consideration should be made of the resonant contributions of the mounting technique.

The embodiment 40 of the present invention is preferably scaled in size for emphasis in the middle harmonics, upper harmonics, or both. If scaled for bass emphasis, the size of this embodiment 40 would often be too large for ease of use. The number of flat plate movable resonators 42 can vary. Thinner stacks with fewer plates than as shown will be more suitable for higher midrange harmonic emphasis than will one with as many or more.

The tips of the flat plate movable resonators 42 furthermost away from fastener assembly 44 will be used for purposes of reference.

An equal resonance configuration is shown in FIG. 2. Here there is a constant distance between pairs of tips, creating multiples of same sized freely resonant portions of the flat plate movable resonators 42. A staggered resonance configuration would result if the distances were to vary smoothly from small to large. This would create a broader and lower-Q range of resonances.

To increase the contributions of higher frequency transverse resonances, contiguous flat plate movable resonators 42A and 42B should be rotated in opposite directions. Conversely, to decrease the contributions of higher frequency transverse resonances, multiples of contiguous flat plate movable resonators 42 can be rotated in the same direction.

Contrast is created with the amount of distance between the tips of the flat plate movable resonators 42. Small distances between alternate tips will create small freely resonant areas with correspondingly higher resonant frequencies. Small distances between tips also create a mostly closed embodiment 40 that will be relatively dampened towards higher frequency resonances, except at the tips and some edges. Thus in the case just described, embodiment 40 would predominately resonate in the lowest middle frequencies possible, and at the highest frequencies possible. This will create the highest contrast. A condition of much less contrast is shown in FIG. 2.

Some of the placements for embodiment 40 include the tops of microphonic audio equipment, the tops of upright pianos, and the frames of grand pianos. If equipped with gripping surfaces as in embodiment 10, embodiment 40 could be used in situations where a hand held musical instrument needed more complexity and quality in its upper harmonics.

FIGS. 3A, 3B, 3C

The manner of use of embodiment 50 of the present invention is similar to that of embodiment 10. However, embodiment 50 is primarily designed to be gravity coupled, and thus it is placed on or in a host component. If use with several host components is not a factor, embodiment 50 can be permanently mounted if consideration is made of the resonant contributions of the mounting technique.

A plurality of rod-shaped movable resonators 14 are used to effect one or more multiples of equal resonances or one or more ranges of staggered resonances. Embodiment 50 is for use when the basic operational use of rod-shaped moveable resonators 14 is understood, and more resonances or more resonant energy is needed to achieve an intended result. Embodiment 50 is also used where its larger size is not a problem.

Some of the placements for embodiment 50 of the present invention include the tops of microphonic electronics, inside rack cabinets housing microphonic equipment, the tops of upright pianos, and the frames of grand pianos.

FIGS. 4A, 4B

The manner of use of embodiment 60 of the present invention is similar to that of embodiment 10. However, embodiment 60 is primarily designed to be gravity coupled, and thus it is placed on or in a host component. If use wit several host components is not a factor, embodiment 60 can be permanently mounted if consideration is made of the resonant contributions of the mounting technique. How the mounting technique changes the resonant contributions of embodiment 60 is also to be considered.

A primary use for embodiment 60 is grand piano bass augmentation, as the low frequency energy produced by many grand pianos is problematic. It should be scaled for the piano, and placed across its frame at the bass strings. A simple augmentation of low frequency energy will usually cause midrange imbalances. Therefore, a low frequency bar resonator 62 with adjustable midrange characteristics from movable bar resonator 64 is needed to be able to balance the increased low frequency energy with the bass and midrange energy already produced by the piano.

Movable bar resonator 64 is extended either in line with bar resonator 62 or rotated about fastener assembly 66 until the desired balance is obtained.

A T-slot 68 and embodiment 40 will allow fine-tuning of the bass harmonic most in need of augmentation, and allow augmentation of the upper harmonics of the bass notes if needed.

FIGS. 5A, 5B

The manner of use of embodiment 80 of the present invention is to place it on a host component, and extend one, or more slotted crescent shaped movable resonators 86 until the desired balance is obtained. By placing embodiment 80 at an area of unpleasant tubing resonance, the clamping action and the middle upper-frequency harmonic a of embodiment 80 will improve the balance of the highest harmonics of many brass instruments. This will allow them to play louder without creating the unpleasant excess of these highest harmonics that is usually interpreted as distortion.

A creative musician will also be able to find a configuration for embodiment 80 that will make his or her horn have unique tonal complexity and qualities.

FIG. 6

The manner of use of embodiment 90 of the present invention is similar to that of embodiment 10. However, instead of being clamped onto a host component, it is to be soldered into one that is microphonic or vibrationally sensitive. Microphonic audio equipment and electric guitars respond well with this simple and inexpensive treatment that can be easily added without requiring major alterations.

Electric guitars are as sensitive as acoustic guitars as to what they are made from and how they are made. The wiring of an electric guitar is usually done with very thin, light gauge insulated wire. The amount of current found in this circumstance would call for no heavier wire. The resonances created with thin wire are both very low in frequency from the extreme compliance of very thin wire, and at the same time very high in frequency from the wire's slight mass. The low resonance is usually lower than a guitar's range, and so is not useful. The higher resonance is often in the area of the highest harmonics of a guitar, and so can contribute to an unpleasant excess of upper harmonics.

However, the use of heavier wire when its resonant possibilities are utilized will allow a craftsman to add warmth and increase the tonal complexity of an electric guitar easily and very inexpensively.

Embodiment 90 can be soldered into an electric guitar in place of, or partially in place of existing wiring. If partially in place of existing wiring, that which is left of the existing wiring may exist only on one end, or both. The length of any remaining previous wiring 101A and 101B will resonate at a frequency that is partially determined by its length. As shorter lengths will resonate higher in frequency, a longer length will often be preferred. This means that a single 101A and no 101B will usually be preferred over splitting the distance and creating shorter lengths for a 101A and a 101B.

An example of embodiment 90 is a five and a half-inch length of 14-gauge wire, with a distance from 92 to 94 of one and a half-inch, and a distance of two inches from 96 to 98. The overall length of three and a half inches is not too long for most electric guitars. The movement of the knot, keeping its diameter constant, will create different lengths from 92 to 94 and from 96 to 98. This is similar to moving rod-shaped movable resonator 14. As one length grows shorter, the other must grow longer with the accompanying changes in resonant frequency. Contrast is developed with this movement. A further similarity exists with rod-shaped movable resonator 14 in that if the higher resonance is as desired, and the lower is not, a longer or shorter length resonator is needed. In this case, a longer or shorter piece of wire is needed.

A further adjustment is possible in that the diameter of knot 95 is adjustable. The mass of knot 95 isolates the two lengths of insulated wire 91 mechanically, and has further resonant effects due to the compression and tension on the copper strands and insulation of knot 95. A tighter knot 95 will resonate higher in frequency than will a looser knot 95. Knot 95 can be used to create a center resonance, or to further enhance contrast. This parallels the use of outer resonators 12 of embodiment 10.

The resonant qualities of the wire itself are due to the number of strands, the mass of the copper, and the compliance of the insulation of the wire. Stiffer wire will resonate higher in frequency than will looser wire. Soft and flexible insulation is often preferred over stiff and inflexible insulation. However, empirical testing should be used to determine a wire's suitability for a specific task.

Conclusion, Ramifications, and Scope of Invention

Accordingly, the reader will see that a musically resonant apparatus with continuously variable resonances can be used to increase the tonal complexity and quality of live and recorded musical instruments. The present invention is simple to operate, has no unintended side effects, and can be adapted for use in more than one musical situation. In addition, the ability to quickly and easily improve a musical instrument's tonality to such a degree has never before been exhibited. Furthermore, the present invention has the additional advantages in that many people will be able to enjoy a quality of tone that previously they could not have afforded, because the prices of vintage electronics and musical instruments spiral ever higher;

it can be preselected as to its musical relevance and dimensionally scaled for use with any musical instrument;

it can be designed to increase the tonal complexity and quality of all musical instruments, in whatever part or parts of the tonality where improvement is needed or desired;

its design allows the use of common materials, which will lower the cost and make it more affordable, especially for students and others of limited means.

Although the description above contains many specificities, these should not be construed as limiting the scope of the invention but as merely providing illustrations of some of the presently embodiments of this invention. For example, the direction of the grain of the wood used in the embodiments could be changed to some other direction than as given, a torsion or other stress could be used to move an element of the apparatus for the purpose of continuously varying a resonance, and the cross sectional shapes of the apparatus' resonators as given can vary from half-circular, circular, and rectangular to hexagonal, triangular, oval, square, etc.

Thus the scope of the invention should be determined by the appended claims and their legal equivalents, rather than by the examples given.

What is claimed is:

1. A continuously variable musically resonant apparatus for increasing the tone quality of live and recorded musical instruments, comprising:

at least two resonators, said resonators being adjacent and adjustably coupled to each other, said resonators being removably coupled to a host component;

at least one fastener for coupling said resonators together; and wherein said resonators include at least one movable inner resonator and at least two outer resonators, said outer resonators having inner gripping surfaces for gripping both said movable inner resonator and said host component.

2. The continuously variable musically resonant apparatus of claim 1, wherein said movable inner resonator is rod-shaped.

3. The continuously variable musically resonant apparatus of claim 1, wherein said fastener is an adjustable fastener which produces sufficient gripping force to immobilize said movable inner resonator and couple said continuously variable musically resonant apparatus to said host component.

4. The continuously variable musically resonant apparatus of claim 3, wherein at least one of said outer resonators has a slot adapted to receive said adjustable fastener therethrough thereby allowing said outer resonators to slidably move in relation to each other.

5. The continuously variable musically resonant apparatus of claim 1, wherein said host component selected from the group consisting of musical instruments, musical instrument amplifiers, recording equipment, mixing equipment, mastering equipment, playback equipment, vibration sensitive components, and microphonic components.

6. A continuously variable musically resonant apparatus for increasing the tone quality of live and recorded musical instruments, comprising:

at least two resonators, said resonators being adjacent and adjustably coupled to each other, said resonators being removably coupled to a host component;

at least one fastener for coupling said resonators together;

wherein said resonators are a plurality of similarly shaped flat plates; and wherein said fastener is an adjustable fastener which passes through said flat plates at right angles to the plane of said flat plates, allowing said flat plates to freely rotate about the axis of said adjustable fastener.

7. The continuously variable musically resonant apparatus of claim 6, wherein said flat plates are circular shaped, and said adjustable fastener is mounted off center to the central axis of said circular shaped flat plates.

8. The continuously variable musically resonant apparatus of claim 6, wherein said flat plates are triangular shaped.

9. The continuously variable musically resonant apparatus of claim 6 further comprising a support resonator, wherein said support resonator defines a T-slot adapted to receive an end of said adjustable fastener.

10. The continuously variable musically resonant apparatus of claim 6, wherein said host component selected from the group consisting of musical instruments, musical instrument amplifiers, recording equipment, mixing equipment, mastering equipment, playback equipment, vibration sensitive components, and microphonic components.

11. A continuously variable musically resonant apparatus for increasing the tone quality of live and recorded musical instruments, comprising:

at least two resonators, said resonators being adjacent and adjustably coupled to each other, said resonators being removably coupled to a host component;

at least one fastener for coupling said resonators together;

wherein said resonators is at least one support resonator and at least one movable resonator, said movable resonator freely pierces said support resonator; and wherein said fastener is at least one adjustable fastener received through said support resonator, wherein each movable resonator has a said adjustable fastener located adjacent thereto.

12. The continuously variable musically resonant apparatus of claim 11, wherein said host component selected from the group consisting of musical instruments, musical instrument amplifiers, recording equipment, mixing equipment, mastering equipment, playback equipment, vibration sensitive components, and microphonic components.

13. The continuously variable musically resonant apparatus of claim 11, wherein said support resonator is a bar shaped resonating resonator holder, and said fastener is at least one adjustable fastener.

14. The continuously variable musically resonant apparatus of claim 11, wherein said movable resonator is rod shaped.

15. A continuously variable musically resonant apparatus for increasing the tone quality of live and recorded musical instruments, comprising:

at least two resonators, said resonators being adjacent and adjustably coupled to each other, said resonators being removably coupled to a host component;

at least one fastener for coupling said resonators together; and wherein said resonators are crescent shaped flat plate resonators having smoothly rounded ends and a constant thickness.

16. The continuously variable musically resonant apparatus of claim 15, wherein at least one of said crescent shaped resonators is movable with respect to the other said crescent shaped resonator.

17. The continuously variable musically resonant apparatus of claim 16, wherein said fastener is an adjustable fastener, said crescent shaped resonators are removably coupled to said host component by rotating at least one of said crescent shaped resonators so that the inner circumference of said crescent shaped resonators can engage said host component.

18. The continuously variable musically resonant apparatus of claim 15, wherein at least one of said crescent shaped resonators is slotted and at least one of said crescent shaped resonators is not slotted, said slotted resonator is shorter in chord length than said non-slotted resonator.

19. The continuously variable musically resonant apparatus of claim 15 further comprising a spacer located between said crescent shaped resonators.

20. The continuously variable musically resonant apparatus of claim 15, wherein said resonators are made of metal, and said fastener is a threaded fastener and nut.

* * * * *